US011125071B2

(12) United States Patent
Yin et al.

(10) Patent No.: US 11,125,071 B2
(45) Date of Patent: Sep. 21, 2021

(54) DOWNHOLE FAILURE ANALYSIS AND PROCESSING METHOD BASED ON THE PARTICLE DIAMETER DISTRIBUTION OF CUTTINGS

(71) Applicant: SOUTHWEST PETROLEUM UNIVERSITY, Chengdu (CN)

(72) Inventors: Hu Yin, Chengdu (CN); WenFeng Yin, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/078,110

(22) Filed: Oct. 23, 2020

(65) Prior Publication Data

US 2021/0040835 A1 Feb. 11, 2021

(30) Foreign Application Priority Data

Aug. 20, 2020 (CN) ..... 202010844418.6

(51) Int. Cl.
*E21B 44/00* (2006.01)
*E21B 49/00* (2006.01)
*E21B 43/34* (2006.01)

(52) U.S. Cl.
CPC ..... *E21B 44/00* (2013.01); *E21B 43/34* (2013.01); *E21B 49/005* (2013.01)

(58) Field of Classification Search
CPC ..... E21B 44/00; E21B 43/34; E21B 49/005
See application file for complete search history.

(56) References Cited

U.S. PATENT DOCUMENTS

| | | | | |
|---|---|---|---|---|
| 10,781,681 | B2 * | 9/2020 | Santos | E21B 47/07 |
| 10,871,762 | B2 * | 12/2020 | Elyas | G06N 20/00 |
| 2016/0245048 | A1 * | 8/2016 | Jamison | E21B 44/04 |
| 2018/0149011 | A1 * | 5/2018 | Dykstra | E21B 44/00 |

OTHER PUBLICATIONS

Sun et al., "Mechanical Principles Course Design", pp. 3-5, Donghua University Press, Mar. 31, 2015.

* cited by examiner

*Primary Examiner* — Silvana C Runyan

(57) ABSTRACT

The invention introduces a downhole failure analysis and processing method and device based on the partical diameter distribution of drilling cuttings. The device includes body frame, screening component, feeding system, weighing mechanism, driving mechanism and control system, which can realize automatic grading and screening according to the partical diameter of cuttings and weigh the cuttings at all levels; the method adopts the debris sieving device to measure the particle diameter distribution of cuttings, establishes a standard partical diameter distribution database of cuttings, compares with the real-time partical diameter distribution of cuttings to detect the downhole failure, and then selects the corresponding failure solution from the downhole failure data to remove the downhole failure. The invention can sieve cuttings according to the partical diameter grading, obtain the partical diameter distribution of cuttings, quickly identify the downhole failure according to the partical diameter distribution of cuttings, and remove the downhole failure.

3 Claims, 17 Drawing Sheets

DOWNHOLE FAILURE ANALYSIS AND PROCESSING METHOD BASED ON THE PARTICLE DIAMETER DISTRIBUTION OF CUTTINGS

TECHNICAL FIELD

The invention relates to a downhole failure analysis and processing method and device based on the partical diameter distribution of cuttings, belonging to the technical field of drilling and logging.

DESCRIPTION OF RELATED ART

Cuttings refer to the rock debris, which is carried out from the surface by the circulating media after the bit breaks the rock mass during drilling. It is an important basis to reflect the formation data, the rock breaking mechanism of the bit, the collapse amount of the borehole wall and the condition of the rock carrying the drilling fluid. The diameter and quantity of cuttings produced by different formations, wellbore collapse conditions and different drilling technologies are different. Studying the partical diameter distribution law of cuttings can explore the rock drillability of corresponding strata and the rock fragmentation mechanism of corresponding drilling technology, and provide theoretical basis and technical reference for studying rock crushing technology and improving drilling efficiency.

Debris logging technology mainly refers to the logging technology that collects and analyzes the cuttings returned to the wellhead according to a certain time sequence and sampling interval during the drilling process, so as to realize the understanding of the logging technology for downhole profile. Conventional debris logging technology is mainly used to analyze the lithology of cuttings, but the partical diameter distribution of cuttings is rarely measured and analyzed. However, the partical diameter distribution of cuttings can reflect various downhole conditions during drilling, which is of great reference value for drilling analysis.

SUMMARY

The invention is mainly to overcome the shortcomings in the existing technology, which is a downhole failure analysis and processing method and device based on the partical diameter distribution of cuttings. This invention is used to screen the cuttings from the backflow hole in the drilling process according to the partical diameter of cuttings and weigh them to obtain the partical diameter distribution of cuttings. The downhole failures are identified according to the partical diameter distribution of cuttings, and the appropriate failure treatment method is adopted to remove the downhole failures.

The invention provides a technical solution to the above technical problems as follows: a multilevel diameters of cuttings screening and weighing device, including:

The body frame is provided with a guide rail, a guide rod parallel to the guide rail and a catch tray located below the guide rail;

Screening component comprises a box frame and a number of sieving boxes mounted in the box frame in turn from the top to the bottom. The bottoms of the sieving boxes are provided with a number of sieving holes and the sieving holes of the same box have the same aperture, but the apertures of the sieving holes of the sieving boxes decrease in turn from the top to the bottom. The upper and lower ends of the box frame are slidably connected to the rod and the guide rail respectively;

The feeding system is mounted on the upper part of the body frame and is capable of conveying materials to the sieving box;

The weighing mechanism is located below the catch tray; and

The driving mechanism, which is connected with the box frame, driving the box frame to make horizontal reciprocating motion on a guide rail.

A further embodiment is that the box frame comprises:

The bottom plate is provided with a sliding chute and a striker plate. The sliding chute is slidably connected with the rails and the striker plate is cylindrical with openings at both ends.

The top plate is located directly above the bottom plate, and the top plate is provided with a fastening cover hole, a debris pipe mouth, a water pipe mouth, and a guide ring, which is in sliding coordination with the guide rod on the body frame;

The upper and lower ends of the fixing plate can be disassembled and connected to the left end surface of the top and bottom plate respectively;

The upper and lower ends of the pulling plate can be disassembled and connected to the right end surface of the top and bottom plate respectively. The side of the pulling plate is provided with a hinge seat, which is hinged to the driving mechanism; and Fastening rod. One end of the fastening rod is fixed on the bottom plate, and the other end of the fastening rod passes through the fastening cover hole of the sieving box and the top plate.

A further embodiment is that the sieving box comprises:

The sieving box body is provided with a fastening hole at the four corners of the sieving box body, and the fastening hole is passed through by the fastening rod;

Screening plate assembly. Assembly is arranged at the inner bottom of the sieving box body, including fixing screening plate, rotating shaft whose both ends are rotationally connected in the sieving box body and flip screening plate that is fixed on the outer circumference surface of the rotating shaft.

Steering engine of screening plate. It is fixed on the side of the sieving box body, driving the rotating shaft to rotate.

In a further embodiment, the weighing mechanism comprises:

A weighing shaft, both ends of which are rotationally connected to the lower part of the body frame;

The weighing bed is fixed and mounted on the weighing shaft, and the middle part of the weighing bed is provided with a second through hole;

The weighing scale is fixed on the weighing bed, and the middle of the weighing scale is provided with a first through hole;

The weighing plate is fixed on the weighing scale and located directly below the catch tray, which is funnel-shaped and provided with a filter screen at the bottom, and the filter screen is aligned with the first through hole and the second through hole;

Steering engine weighing shaft. It drives and connects with the weighing shaft.

In a further embodiment, the driving mechanism comprises a belt, a hinge pin, a crank-slider assembly fixedly installed on the body frame, and a motor, wherein the crank-slider assembly is connected with the hinge seat by a rotating pair through the hinge pin, and the motor drives the crank-slider assembly to move through the belt.

In a further embodiment, the feeding system comprises:

The debris pipe connector is installed on the upper part of the body frame;

The water pipe connector is installed on the upper part of the body frame;

The debris pipe is connected with the debris pipe mouth and debris pipe connector at both ends respectively; and The two ends of the water pipe are respectively connected with the water pipe mouth and water pipe connector.

In a further embodiment, the device also has a control system, which contains the controller and the transmission lines; a debris feeding valve is arranged on the debris pipe connector, the water pipe connector is provided with an inlet valve, and the controller is electrically connected with the debris feeding valve, inlet valve, sieving plate steering machine, weighing scale and weighing shaft steering machine respectively through the transmission line.

A downhole failure analysis and treatment method based on partical diameter distribution of cuttings includes the following steps:

S1. Establish a standard distribution database of partical diameter of cuttings for normal drilling and different types of downhole failures;

S2. Establish a database of treatment schemes for different types of downhole failures;

S3. The cuttings returned to the wellhead are collected and graded and weighed according to the partical diameter of cuttings by the screening and weighing device of Claim 1 to obtain the real-time partical diameter distribution of cuttings, and then determine whether the real-time partical diameter distribution of cuttings is consistent with the standard partical diameter distribution of cuttings;

S4. Make real-time judgement based on whether the real-time partical diameter distribution of cuttings is consistent with the standard partical diameter distribution of cuttings:

If the real-time partical diameter distribution of cuttings is consistent with the standard partical diameter distribution of cuttings of different types of downhole failures, the corresponding standard downhole failure treatment scheme shall be searched from the failure treatment scheme database immediately. After the downhole failure is handled and resolved, continue to drill;

If the real-time partical diameter distribution of cuttings is not consistent with any standard partical diameter distribution of cuttings in the standard distribution database of partical diameter of cuttings, it means that there is a new failure in the downhole that has never occurred before. Drilling should be stopped immediately, downhole failure analysis should be carried out, and effective failure treatment schemes should be formulated. Drilling will continue after the failure treatment is completed and the data of the standard distribution database of partical diameter of cuttings and the treatment scheme database should be updated.

In a further embodiment, the partical diameter distribution of cuttings can be obtained as follows:

a. Take the time $\Delta t$ as the sampling interval and sieve and weigh the debris returned in the $\Delta t$ interval according to the distribution of cuttings with the screening and weighing device of claim 1;

b. Record the total weight of sampled debris W and the weight of the cuttings of various diameters $W_k$;

c. Calculate the partical diameter distribution of cuttings $f_k$ in the interval $\Delta t$ according to the following formula:

$$f_k = \frac{W_k}{W}$$

In this formula, $f_k$ means the partical diameter distribution of cuttings; W means the total weight of sampled debris; and $W_k$ means the weight of cuttings with different diameters.

In a further embodiment, the specific steps described to determine whether the real-time partical diameter distribution of cuttings is consistent with the standard partical diameter distribution of cuttings are as follows:

A. According to the following formula, the single-level deviation $g_k$ of the real-time partical diameter distribution of cuttings relative to the standard partical diameter distribution of cuttings is calculated;

$$g_k = \frac{|p_k - q_k|}{p_k}$$

In this formula, $p_k$ means the mass percentage of the debris in the standard partical diameter distribution of cuttings; and $q_k$ means the mass percentage of debris in the real-time partical diameter distribution of cuttings;

B. All single-level deviations $g_k$ are summed to obtain the real-time partical diameter distribution of cuttings relative to the standard partical diameter distribution of cuttings;

C. Then, according to the single-level deviation $g_k$ and the single deviation $G_p$, the single-level similarity $d_k$ and $D_s$ are obtained.

$$d_k = 1 - g_k$$

$$D_s = n - Gp$$

In the formula, n means the partical diameter level of cuttings.

D. According to the set single-level consistent judgement value $d_d$ and the overall consistent similarity judgement value $D_d$, the judgment is made. When $d_k \geq D_d$, k=1, 2, . . . k; and $D_s \geq D_d$, the real-time partical diameter distribution of cuttings is consistent with the standard partical diameter distribution of cuttings. Otherwise, the real-time partical diameter distribution of cuttings is not consistent with the standard partical diameter distribution of cuttings.

The invention has the following beneficial effects:

1. The partical diameter distribution of cuttings logging method provides a new means for drilling and logging by obtaining the backflow cuttings in the drilling process and sieving the cuttings according to the partical diameter of cuttings to obtain the partical diameter distribution of cuttings.

2. The multilevel diameters of cuttings sieving and weighing device integrates the multilevel sieving boxes 22 into one through the screening component 2, which can screen the multilevel diameters of cuttings at one time, and has a weighing mechanism 4, which can realize timely weighing after the multilevel sieving and improve the working efficiency;

3. The cuttings returned from drilling can be used to test the real-time partical diameter distribution of cuttings, which is low-cost and can truly reflect the downhole situation. The use of database can make the downhole failure identification and failure treatment timely and efficient.

DETAIL DESCRIPTIONS

The invention will be further explained below in combination with examples and drawings.

Figure 1:
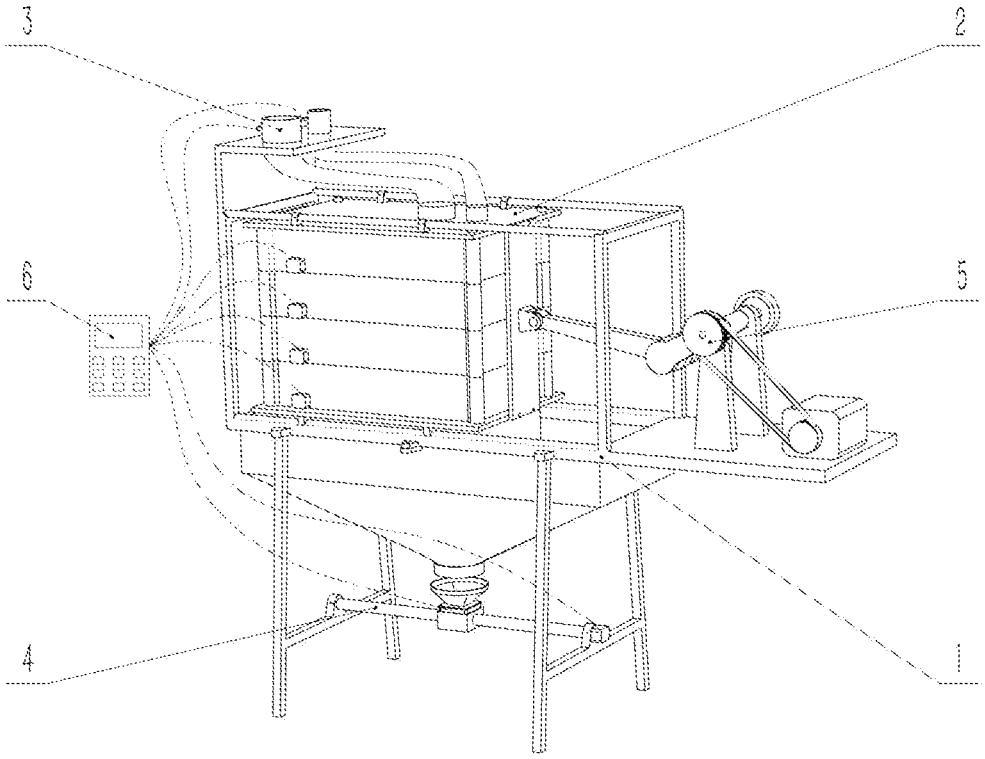
FIG. 1 Schematic diagram of the structure of screening and weighing device.
Figure 2:
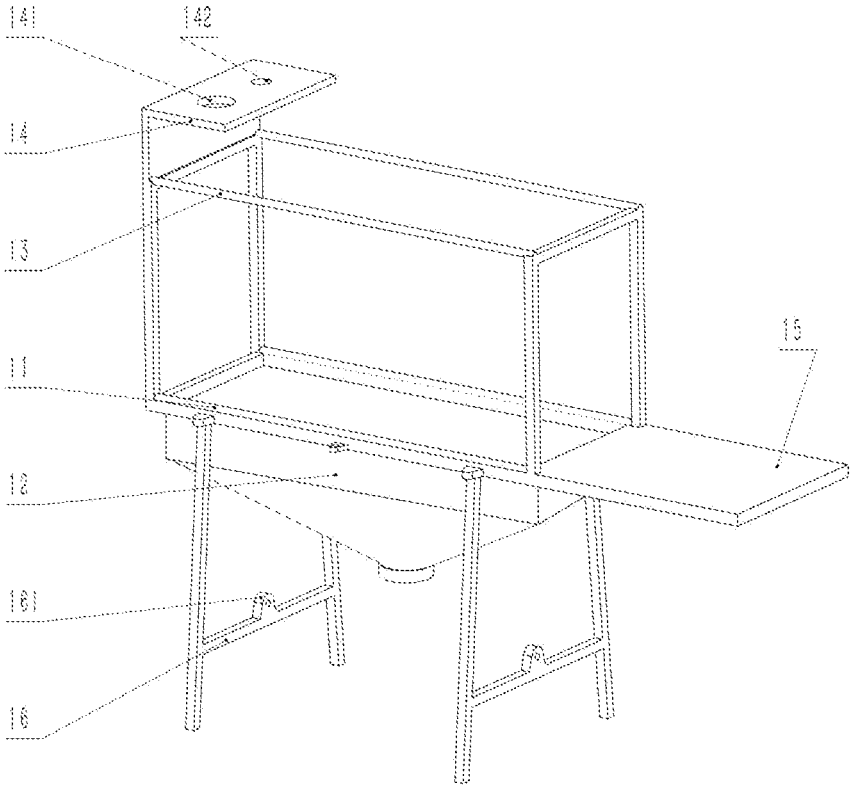
FIG. 2 Schematic diagram of the structure of frame.

As shown in FIG. 1, a multilevel diameters of cuttings screening and weighing device of the invention includes: frame 1, screening component 2, feeding system 3, weighing mechanism 4, driving mechanism 5, and control system;

As shown in FIG. 2, the body frame 1 is equipped with a guide rail 11, a catch tray 12, a guide rod 13, a first platform 14, a second platform 15, and a beam 16;

The first platform 14 is located at the uppermost part of the body frame 1 and is provided with a debris hole 141 and a water hole 142 for installing a debris pipe connector 31 and a water pipe connector 32.

The number of the guide rails 11 is two. The guide rails 11 are located in the middle of the body frame 1 and are arranged horizontally. The two guide rails 11 are parallel to each other. The bottom of the screening component 2 is slidably connected to the guide rail 11 and is located between the two guide rails 11. The screening component 2 can make reciprocating movements on the guide rails 11.

The number of guide rods 13 is also two. The guide rods 13 are directly above the guide rail 11, which are horizontally arranged and parallel to the guide rail 11. The upper part of the screening component 2 is installed on a guide rod 13, which plays a role of guiding the reciprocating movement of the screening component 2.

Figure 3:
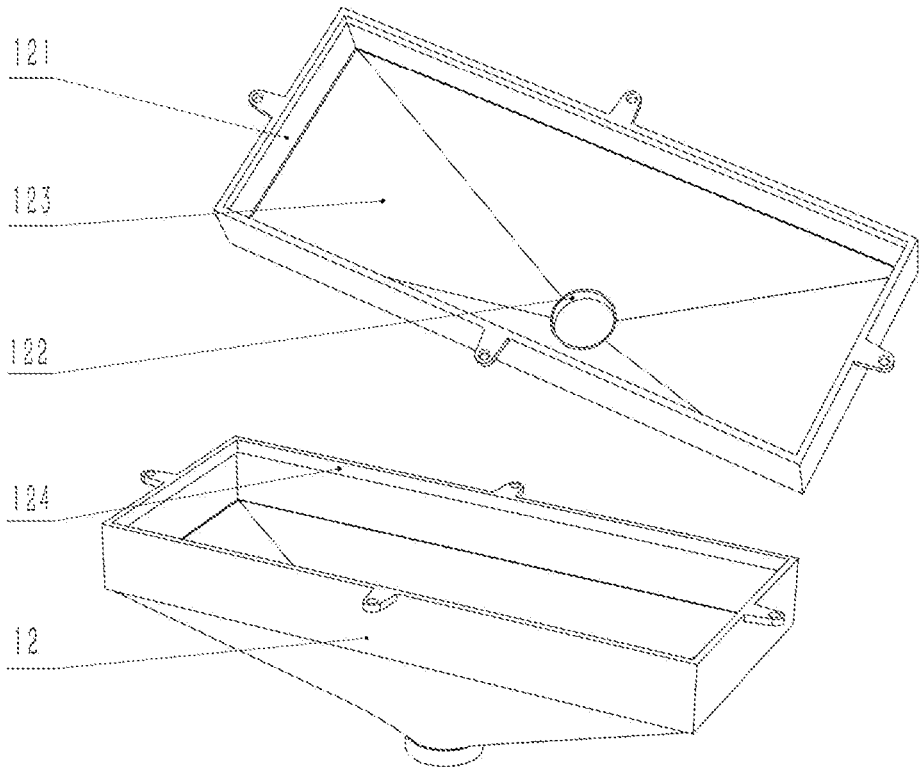
FIG. 3 Schematic diagram of the structure of catch tray.

The catch tray 12 is located under the guide rail 11 and is detachably connected with the body frame 1. As shown in FIG. 3, the upper end of the inner cavity of the catch tray 12 is provided with a large opening 121, the lower end is provided with a small opening 122, and the middle part is provided with an inclined plane. The large opening of the catch tray 12 is located under the screening component 2, which can receive the debris and water dropped by the screening component 2 during the movement. The small opening of the catch tray 12 is aligned with the weighing mechanism 4, which can send debris and water into the weighing mechanism 4 for weighing. The inner side of the big opening 121 is provided with a water outlet pipe 124 which surrounds the large opening, and the water outlet pipe 124 is connected with the water pipe connector 32. A plurality of evenly distributed water outlet holes are arranged on the water outlet pipe 124, and the water discharged from the water outlet holes can clean the catch tray 12.

As shown in FIG. 2, the second platform 15 is located in the middle of the body frame 1 and is used for installing the driving mechanism 5.

As shown in FIG. 2, the body frame is provided with a total of two beams 16, the beam 15 is located at the lower part of the body frame 1, and the beam 15 is provided with a bearing block 161 which is used to install the weighing mechanism 4.

The screening component 2 comprise a box frame 21 and four sieving boxes 22 installed in the box frame 21 from the top to the bottom.

Figure 4:
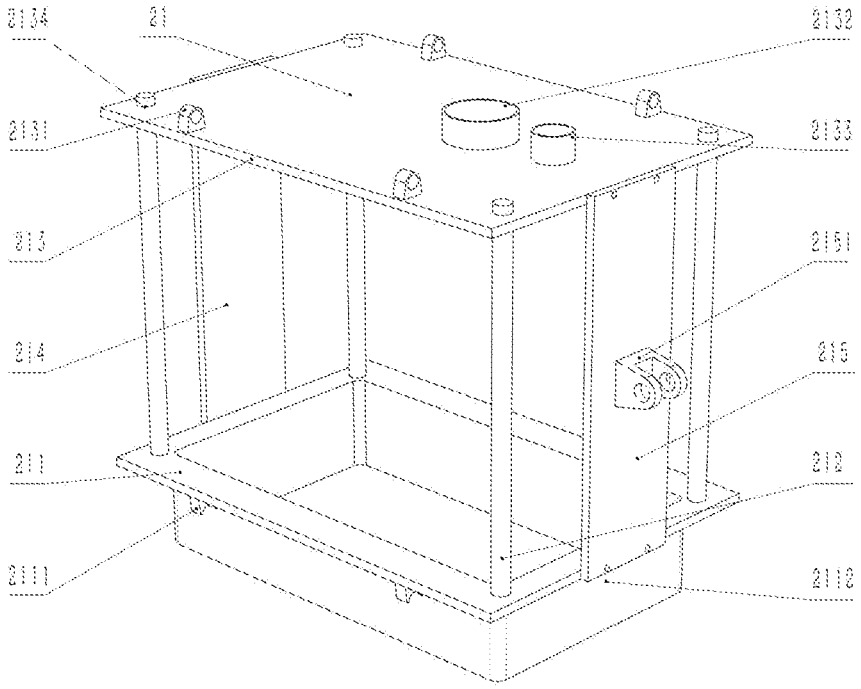
FIG. 4 Schematic diagram of the structure of the box frame.

As shown in FIG. 4, the box frame 21 includes a bottom plate 211, a fastening rod 212, a top plate 213, a fixing plate 214, and a pulling plate 215. The main function of the box frame 21 is to fix the sieving box 22 and connect with the driving mechanism 5 and the guide rail 11 and guide rod 13 of the body frame 1, so that the screening component 2 can make reciprocating motion along the guide rail 11 of the body frame 1 under the driving mechanism 5.

The bottom plate 211 is located at the lower part of the box frame 21, and the bottom plate 211 is provided with four sliding chutes 2111, which are slidably connected with the guide rail 11 of the body frame 1; the combination of the sliding chute 2111 and the guide rail 11 can reduce the resistance of the screen components 2 to do reciprocating motion. The middle part of the bottom plate 211 is opened, and a striker plate 2112 is installed around the bottom plate 211. The striker plate 2112 is a cylindrical shape with two ends open. One end of the opening of the striker plate 2112 is aligned with the bottom of the sieving box 22 to receive the debris and water dropped from the sieving box 22; the other end of the opening is aligned with the catch tray 12 to discharge the debris and water to the catch tray 12. One end of the four fastening rods 212 is installed on the upper part of the bottom plate 211, and the other end is provided with threads, which pass through the sieving box 22 and the top plate 213, and then are fastened with nuts, so as to lock the sieving box 22.

The top plate 213 is located above the bottom plate 211. The top plate 213 is provided with a fastening hole 2215, and the fastening rod 212 can pass through the fastening hole 2215. The fastening rod 212 and the fastening hole 2215 are clearance matched. When the nut and the fastening rod 212 are used to lock the sieving box 22, the top plate 213 can move along the direction of the fastening rod 212 to facilitate the loosening or locking of the sieving box 22. Four guide rings 2131 are arranged on the upper part of the top plate 213. The guide ring 2131 slides with the guide rod 13 on the body frame 1 to guide the reciprocating motion of the screening component 2. The upper part of the top plate 213 is provided with a debris nozzle 2132 and a water nozzle 2133. Both the debris nozzle 2132 and the water nozzle 2133 are cylinders with open ends. Through the debris nozzle 2132 and the water nozzle 2133, the debris and water enter the sieving box 22 from the top plate 213 respectively. The upper and lower ends of the fixing plate 214 are detachably connected to the left end surfaces of the top plate 213 and the bottom plate 211, respectively, and play a role of reinforcing the box frame 21; The upper and lower ends of the pulling plate 215 are respectively detachably connected to the right end surfaces of the top plate 213 and the bottom plate 211. The pulling plate 215 is provided with a hinge seat 2151, and the hinge seat 2151 is connected with the driving mechanism 5 by a hinge. The hinge seat 2151 is a connection point for the driving mechanism 5 to input driving force to the screening component 2.

Figure 6:
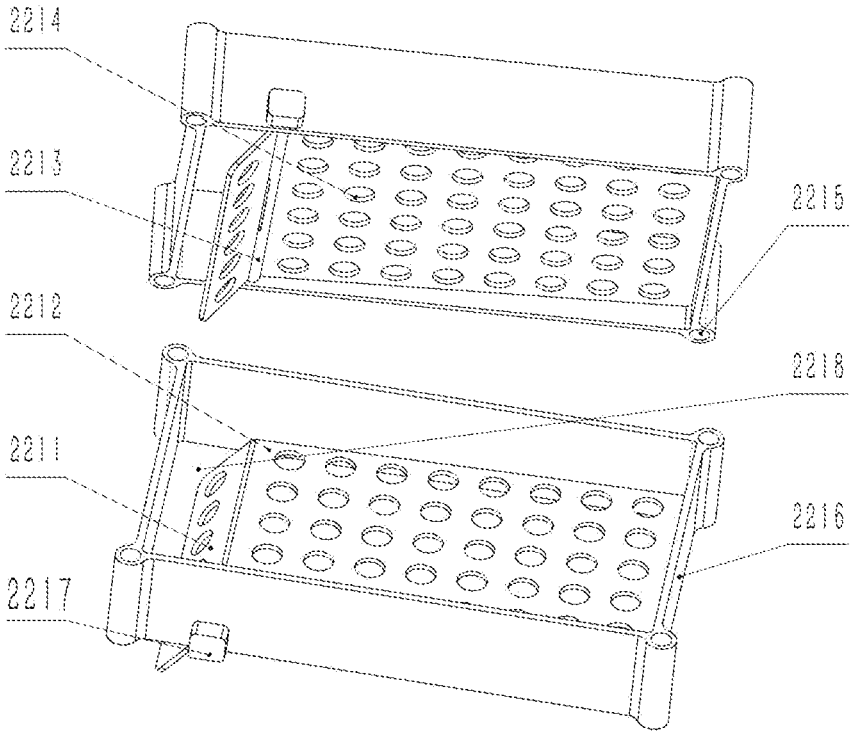
FIG. 6 Schematic diagram of the structure of the sieving box.

As shown in FIG. 6, the sieving box 22 includes a sieving box 2216, a screening plate assembly, and a sieving plate steering gear 2217; the sieving box body 2216 is a square box with an upper opening and a lower part fixing the screening plate assembly. The main function of the sieving box 22 is to screen through the screen holes 2214 to obtain the debris with an aperture larger than that of the screen holes 2214. The four corners of the sieving box body 2216 are provided with fastening holes 2215, which is a through hole. The fastening rod 212 passes through the fastening hole 2215 for clearance matching. The fastening rod 212 can fix and lock the sieving box 22 through the fastening hole 2215;

The screening plate assembly includes a fixed screening plate 2212, a rotating shaft 2213, and a flip screening plate 2211. Both the fixed screening plate 2212 and the flip screening plate 2211 are provided with a number of screen holes 2214. The screen holes 2214 are through holes. An unclosed notch 2218 is left on one end of the fixed screening plate 2212 in the horizontal movement direction of the screening component 2. The cuttings of various diameters can pass through the notch 2218. A flip screening plate 2211 is installed at the notch 2218. The notch 2218 is provided to discharge all the debris in the sieving box 22 for weighing. The fixed screening plate 2212 is inclined to a certain degree in the horizontal movement direction of the screening component 2, and the end with the notch 2218 is lower than the end without the notch 2218. The slope of the fixed screening plate 2212 is conducive to the debris in the sieving box 22, which are completely discharged through the lower notch 2218. The flip screening plate 2211 is installed at the notch 2218, and the flip screening plate 2211 just completely fills the notch 2218. The flip screening plate 2211 and the sieving box 2216 are rotatably connected by the rotating shaft 2213, and can rotate relative to the sieving box 2216. The rotating shaft 2213 is installed on the sieving box 2216 at one end of the fixed screening plate 2212 with a notch 2218. The rotating shaft 2213 can rotate relative to the sieving box 2216. The rotating shaft 2213 and the flip screening plate 2211 are fixedly connected. The sieving plate steering gear 2217 is fixedly installed on the sieving box 2216 and can produce a rotation of 1 to 180°. The sieving plate steering gear 2217 is connected with the rotating shaft 2213 and can drive the rotating shaft 2213 and the flip screening plate 2211 to rotate.

In the screening stage, the flip screening plate 2211 blocks the notch 2218 of the fixing plate 214, and the flip screening plate 2211 plays a role of screening. In the stage of discharging debris for weighing, the flip screening plate 2211 is driven by the rotating shaft 2213 to rotate to a certain angle, the notch 2218 of the fixed screening plate 2212 is opened, and the debris is discharged from the sieving box 22.

During the horizontal reciprocating motion of the sieving box 22, when the flip screening plate 2211 is not opened, the debris larger than the aperture of sieving hole 2214 remain in the sieving box 22, and the debris smaller than the aperture of sieving hole 2214 fall out of the sieving box 22 through the aperture of sieving hole 2214; when the flip screening plate 2211 is opened, all the debris in the sieving box 22 fall out of the box 22.

Figure 5:
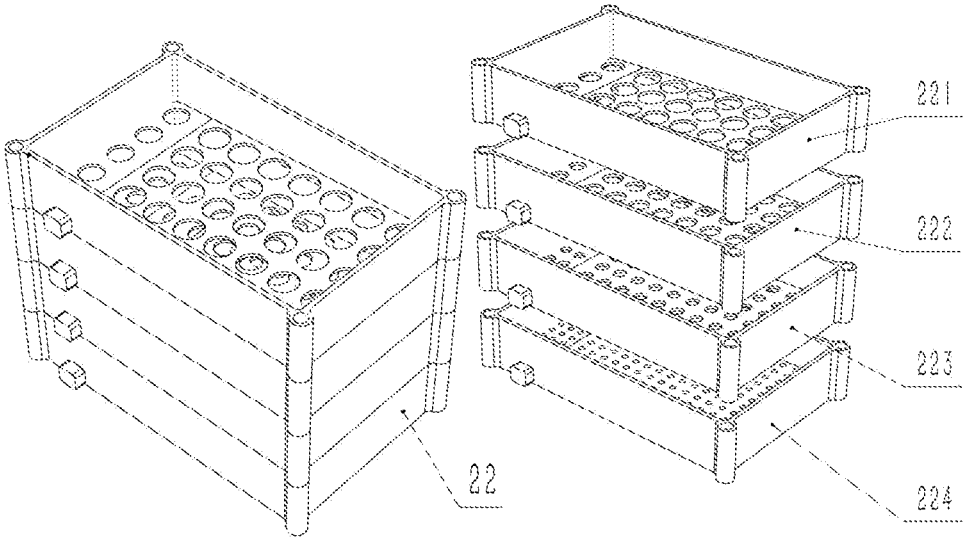
FIG. 5 Schematic diagram of the sieving box set.

As shown in FIG. 5, the sieving box 22 is divided into different levels according to the size of the aperture of sieving hole 2214. The total level of the sieving box 22 and the aperture of sieving hole 2214 of each level of the sieving box 22 are determined by the needs of the analysis project. The sieving boxes 22 of different levels are installed on the box frame 21 from the top to the bottom in order from the largest to the smallest of the aperture of sieving hole 2214 to form a sieving box assembly, which is locked by a screw connection with a fastening rod 212.

In this example, there are four levels of sieving boxes 22, i.e. from the top to the bottom the first level sieving box 221, the second level sieving box 222, the third level sieving box 223 and the fourth level sieving box 224. The apertures of sieving holes 2214 of the sieving boxes are gradually reduced from the top to the bottom. Through the reciprocating motion of the screening assembly 2, the debris of the first-level partical diameter is left in the first-level sieving box 221, while the debris of other diameters falls into the second-level sieving boxes 222, the third-level sieving boxes 223 and the fourth-level sieving boxes 224. The debris of the second-level partical diameter whose partical diameter is slightly smaller is left in the second-level sieving box 222, while the debris of other diameters falls into the third-level sieving boxes 221 and the fourth-level sieving boxes 224. The debris of the third-level partical diameter whose partical diameter is even smaller is left in the third-level sieving box 223, while the debris of other diameters falls into the fourth-level sieving boxes 224. The debris of the fourth-level partical diameter is left in the fourth-level sieving box 224. The debris with the partical diameter that is smaller than the fourth-level partical diameter is not included in the analysis, so such debris falls out of the fourth-level sieving box 224.

After the screening, the flip screening plate 2211 of the fourth-level sieving box 224 is opened first, and the debris in the fourth level sieving box 224 gradually falls into the catch tray 12 from the notch 2218 in the reciprocating motion of the screening component 2, and enters the weighing mechanism for weighing. After the fourth level debris is weighed, the third level sieving box 223, the second sieving box 222 and the first sieving box 221 are opened in turn, and the debris is weighed.

Figure 7:
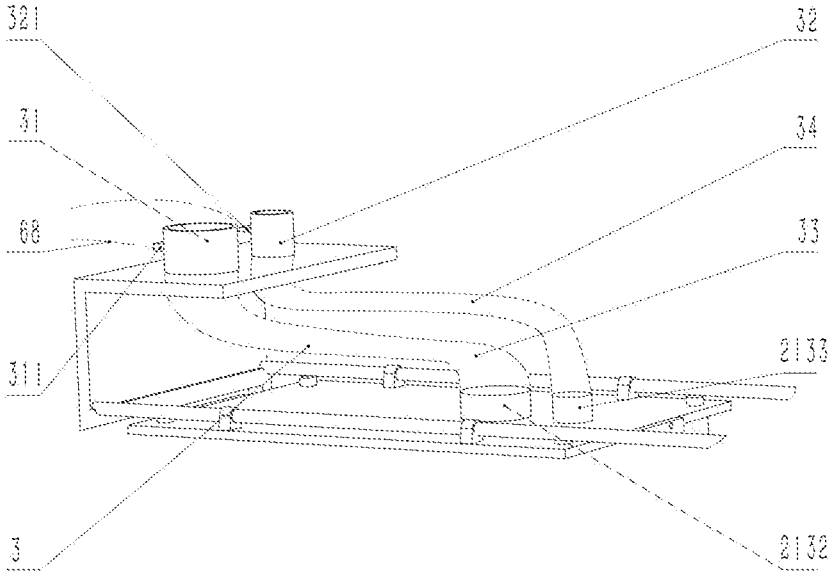
FIG. 7 Schematic diagram of the structure of the feeding system.

As shown in FIG. 1, the feeding system 3 is installed on the upper part of the body frame 1 and can convey materials to the sieving box 22. As shown in FIG. 7, the feeding system 3 includes debris pipe connector 31, water pipe connector 32, debris pipes 33, water pipes 34, debris nozzles 2132, and water nozzles 2133.

The debris pipe connector 31 is provided with a material feeding valve 311. The debris pipe connector 31 is installed on the upper part of the body frame 1 and is located above the screening component 2.

The water pipe connector 32 is provided with a water inlet valve 321, and the water pipe connector 32 is installed on the upper part of the body frame 1 and is located above the screening assembly 2.

The debris pipe 33 is made of flexible retractable material. One end of the debris pipe 33 is connected to the debris pipe connector 31 and the other end is connected to the upper part of the screening component 2 so that the debris can flow into the upper part of the screening component 2 through the debris pipe connector 31.

The water pipe 34 is made of flexible retractable material. One end of the water pipe 34 is connected with the water pipe connector 32 and the other end is connected to the upper part of the screening component 2 so that water can flow into the upper part of the screening component 2 from the water pipe connector 32.

The debris pipe connector 31 and the water pipe connector 32 are installed in the through holes on the first platform of the body frame 1. The inlet ends of the debris pipe connector 31 and the water pipe connector 32 are respectively connected with the down-hole back-flow debris pipeline and the cleaning water pipeline, and the outlet ends are respectively connected with the debris pipe 33 and the water pipe 34 that are made of flexible materials. After the down-hole flow-back debris is screened out through the vibrating screen, it is transported through the pipe to the debris pipe connector 31. When the material feeding valve 311 in the debris pipe connector 31 is opened, the debris is transported through the debris pipe 33 to the sieving box in the screening component. The cleaning water is tap water, which is connected to the water pipe connector 32. When the inlet valve 321 is opened, it is delivered through the water pipe 34 to the sieving box in the screening component to clean the residual debris in the sieving box.

Figure 8:
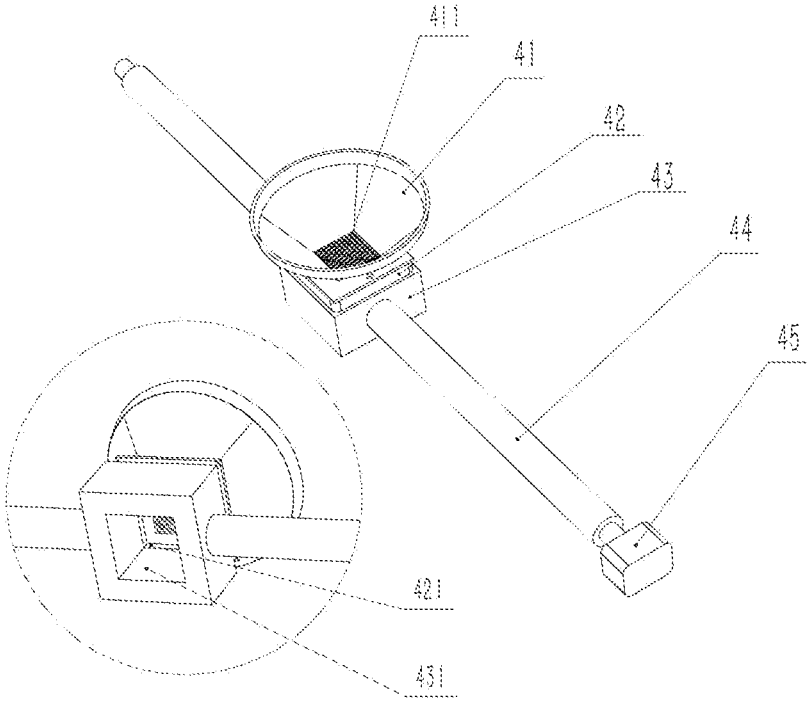
FIG. 8 Schematic diagram of the structure of the weighing mechanism.

As shown in FIG. 8, the weighing mechanism 4 includes a steering engine of weighing shaft 45, a weighing shaft 44, a weighing bed 43, a weighing plate 41 and a weighing scale 42. The weighing plate 41 is a concave container mounted on the weighing scale 42. The weighing shaft 44 is mounted on the bearing pedestal 161 at the lower part of the body frame 1. It is driven by the steering engine of weighing shaft 45 and can rotate relative to the body frame 1. The weighing bed 43 is fixed on the weighing shaft 44, and the middle of the weighing bed 43 is provided with a through hole. The weighing scale 42 is fixed on the weighing bed 43, and the middle of the weighing scale 42 is provided with a through hole. The weighing plate 41, fixed on the weighing scale 42, is located at the lower part of the sieving box 22. The weighing plate 41 is in the shape of a funnel, the bottom of which is provided with a filter screen 411, whose aperture is smaller than the minimum distribution of cuttings to be tested, and the filter screen 411 is aligned with the through holes of the weighing scale 42 and the weighing bed 43.

When the sieved debris is dropped into the catch tray 12 from the sieving box 22 and falls into the weighing plate 41 below the outlet of the catch tray 12 through the outlet of the catch tray 12, the weight of the cuttings of corresponding level in the weighing plate 41 can be weighed by the weighing scale 42. After the weighing result is obtained, the weighing shaft 44 rotates under the drive of the steering engine of weighing shaft 45, and the weighing plate 41 rotates accordingly. After the rotation of 180°, the weighed debris in the weighing plate 41 falls off the weighing plate 41, and then the rotating shaft rotates in reverse to recover for the next weighing.

Figure 9:
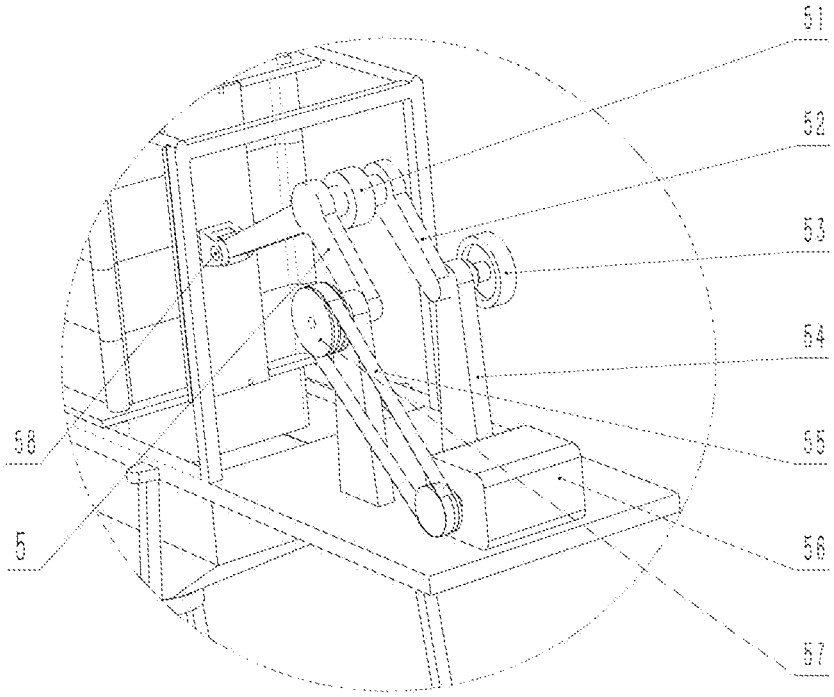
FIG. 9 Schematic diagram of the structure of the driving mechanism.

As shown in FIG. 9, driving mechanism 5 includes motor 56, belt 55, pulley 57, crank 52, flywheel 53, connecting rod 51 and hinge pin 58. Connecting rod 51 is connected with the screening component 2 by a rotating pair through hinge pin 58. Driving mechanism 5, screening component 2, body frame 1 and guide rail 11 constitute the slider-crank mechanism. The motor 56 generates rotating motion and drives the pulley 57 and the crank 52 to rotate through the belt 55. The flywheel 53 stores part of the kinetic energy to enhance the system's stability. The slider-crank mechanism converts the rotating motion of the crank 52 into the horizontal reciprocating motion of the screening component 2.

Figure 10:
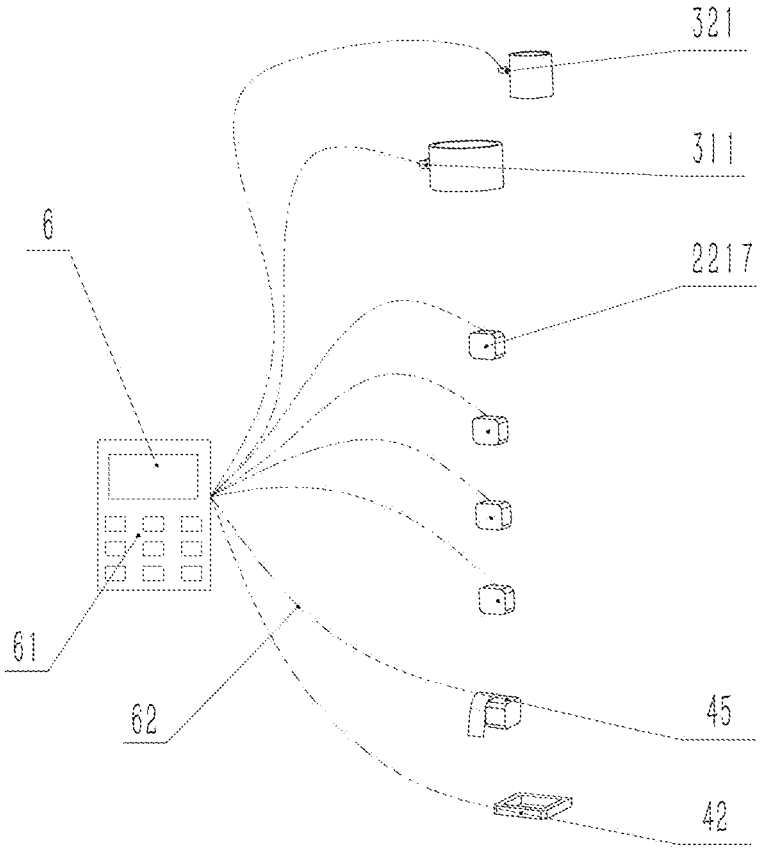
FIG. 10 Schematic diagram of the control system.

As shown in FIG. 10, control system 6 includes controller 61 and transmission line 62. The controller 61 can send action orders to the feeding system 3, the screening component 2 and the weighing mechanism 4 through the transmission line 62. The controller 61 can receive and store the debris weight information transmitted by the weighing mechanism 4, and the controller 61 can coordinate the operation timing of each actuator in the control system 6.

The actuators are cuttings feeding valve 311, inlet valve 321, sieving plate steering gear 2217, steering engine of weighing shaft 45 and weighing scale 42. Cuttings feeding valve 311 and inlet valve 321 are respectively used to control the entry of debris and water into screening component 2 from feeding system 3. sieving plate steering gear 2217 is used to control the opening and closing of sieving boxes 22 at all levels and control whether the debris flows into the catch tray 12. Steering engine of weighing shaft 45 controls the rotation of weighing mechanism 4 to receive the debris from catch tray 12 or to pour out the debris from weighing mechanism 4. Weighing scale 42 weighs the debris and returns the weight information.

The transmission line 62 connects the controller 61 and the actuator to realize the information transmission between the controller 61 and the actuator.

When a debris screening and weighing operation is to be started, controller 61 issues the opening command to cuttings feeding valve 311 through transmission line 62. The cuttings feeding valve 311 opens for a set time, and the set amount of debris passes through the debris pipe 33 and enters the screening component 2, after which the cuttings feeding valve 311 is closed. At the same time, controller 61 issues an opening command to inlet valve 321 through transmission line 62, and the cleaning water enters the screening component 2. In the non-weighing stage, inlet valve 321 is opened all the time, which can help the debris to flow from the top to the bottom in the sieving and weighing device. After the debris enters the screening component 2, the flip screening plates of all sieving boxes 22 are in a closed state, and the screening component 2 performs horizontal reciprocating screening motion. After the set time, the sieving is finished.

After the screening, the cuttings of various diameters stays in the sieving boxes 22 of the corresponding level. After that, controller 61 issues the opening command to the sieving steering engine of the fourth level sieving box 224, and the sieving steering engine rotates to drive the flip screening plate 2211 of the fourth level sieving box 224 to flip and open the notch 2218 of the fourth level sieving box 224. The debris with the fourth level partical diameter falls into the catch tray 12 from the notch 2218, and then falls into the weighing plate from the catch tray 12. The fourth level debris remains in the weighing plate.

During this process, the screening component 2 continues to perform horizontal reciprocating motion to promote the debris to fall along the slope of the fixing plate 214 from the notch 2218; the cleaning water washes the debris remaining in the sieving box 22 and the collection box to the weighing plate, and then the debris flows out from the filter screen 411 of the weighing plate. After the set time or after the weighing value of the weighing scale tends to be stable, controller 61 issues a closing command to the inlet valve 321, and the cleaning water stops flowing into the screening component 2 and the weighing plate to reduce the influence of water flow on the weighing process. After that, the weighing scale transmits the weighing result of the debris with the fourth level partical diameter to the controller 61, and the controller 61 stores the weight data. After that, controller 61 issues pouring command to the steering engine of weighing shaft 45, which drives the weighing shaft to rotate, and the fourth level debris in the weighing plate are poured out of the weighing plate.

After that, the controller 61 issues a reset instruction to the weighing shaft steering gear 45 for weighing the debris of the third level partical diameter. After that, the controller 61 issues opening instructions to the water inlet valve 321 and the screening steering gear of the third level sieving box 223. The screening steering gear rotates, driving the flip screening plate 2211 of the third level sieving box 223 to rotate, and opening the notch 2218 of the third level sieving box 223, and the debris of the third level partical diameter enters the weighing plate for weighing. The above steps are repeated and the weighing of the debris of the fourth level, third level, second level and first level partical diameter is completed in turn. Finally, according to the weighing results, the controller 61 calculates the distribution of the partical diameter of cuttings, and sends a closing instruction to the screening steering gears 2217 of the sieving boxes of the first, second, third and fourth levels to prepare for the next screening and weighing work.

Figure 11:
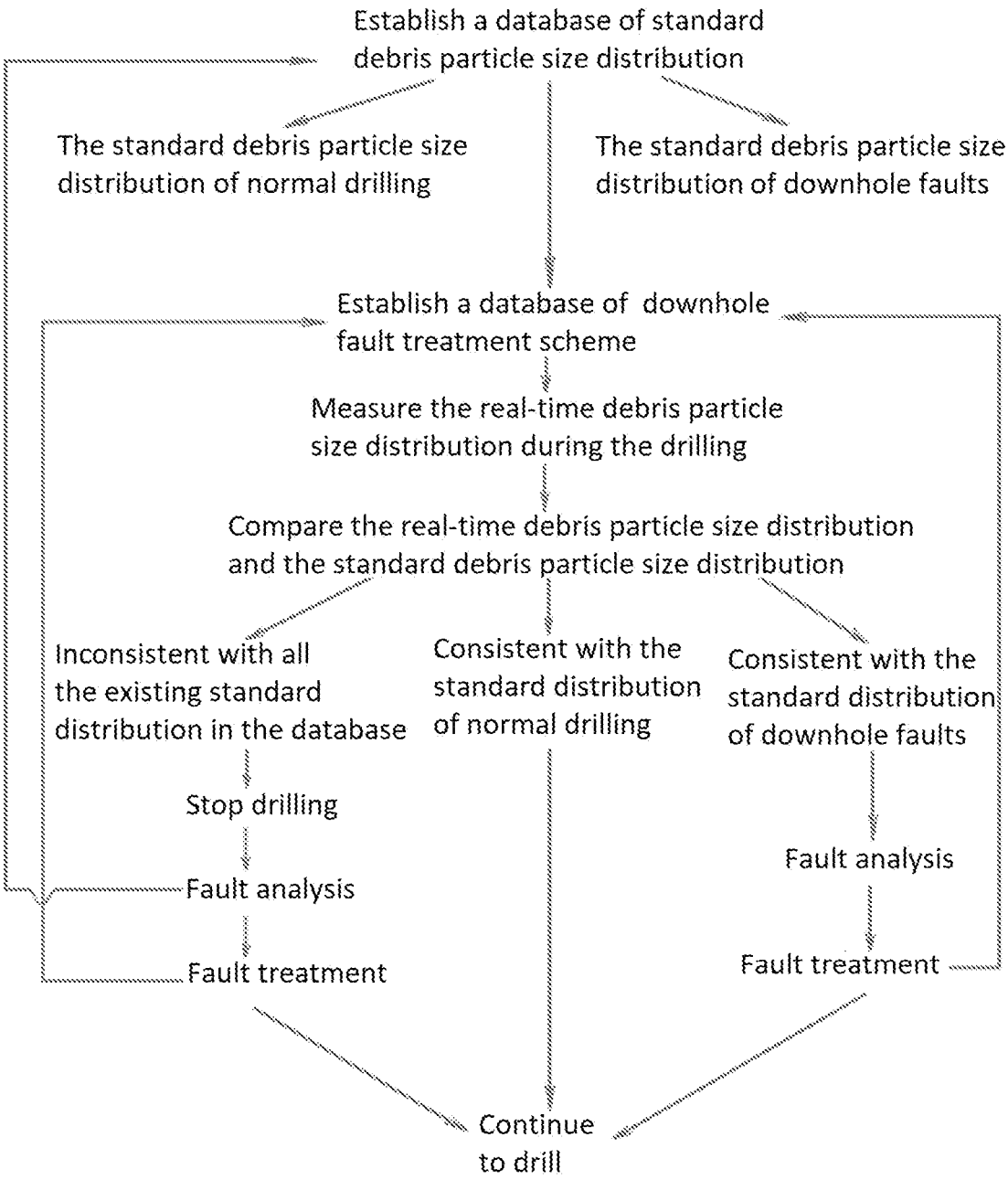
FIG. 11 Flow chart of the invention.
Figure 12:
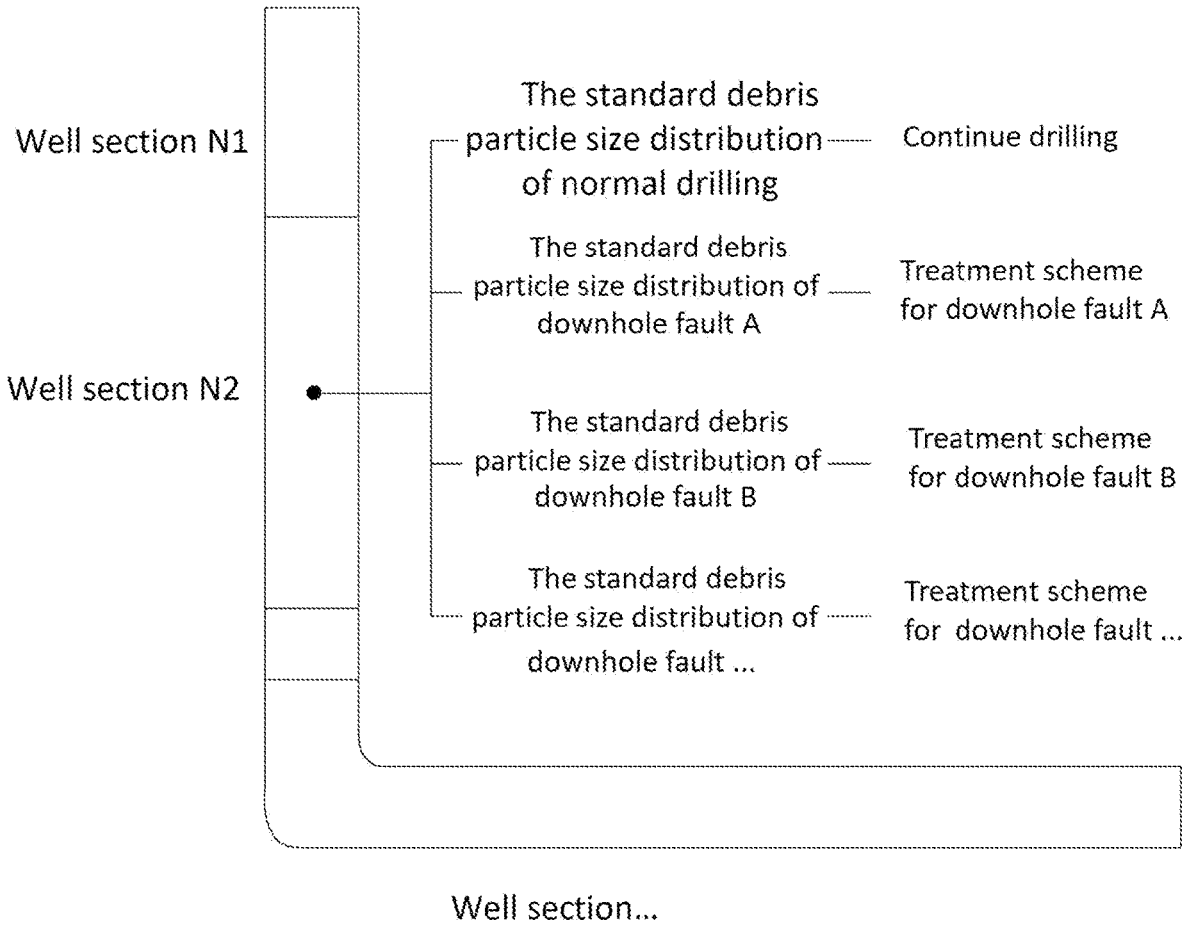
FIG. 12 Data relationship diagram of the downhole failure analysis solution.
Figure 13:
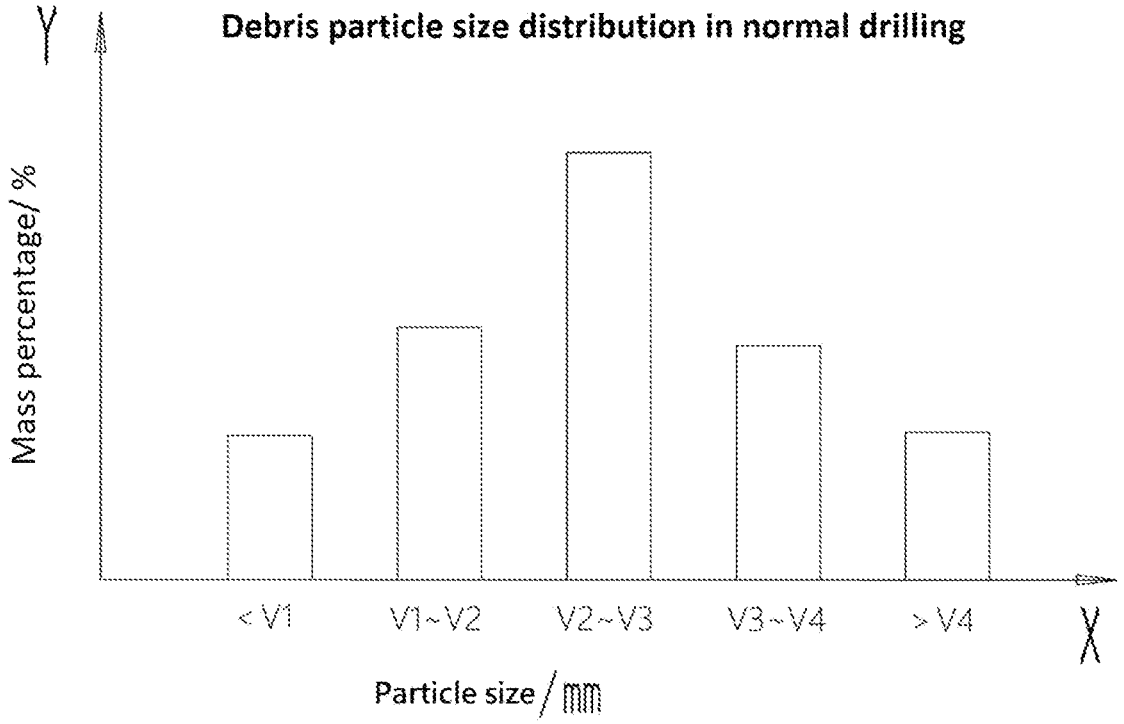
FIG. 13 The standard partical diameter distribution of cuttings in normal drilling.
Figure 14:
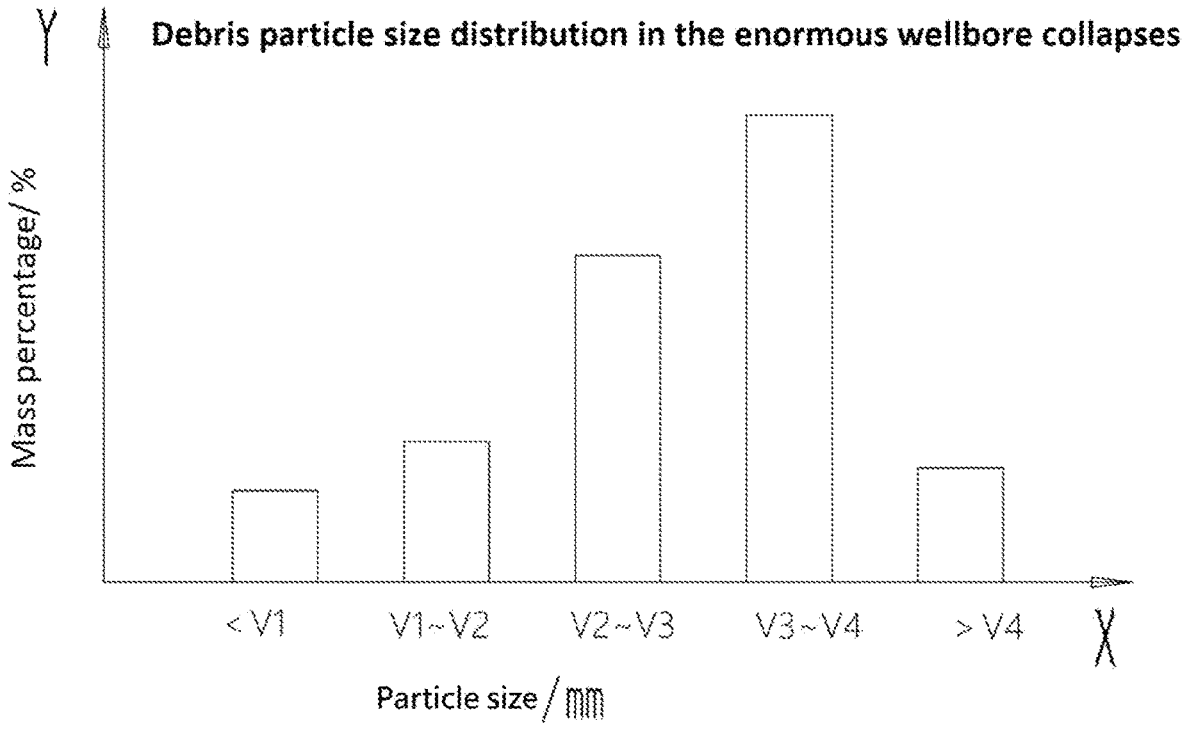
FIG. 14 The standard partical diameter distribution of cuttings in a large number of wellbore collapses.
Figure 15:
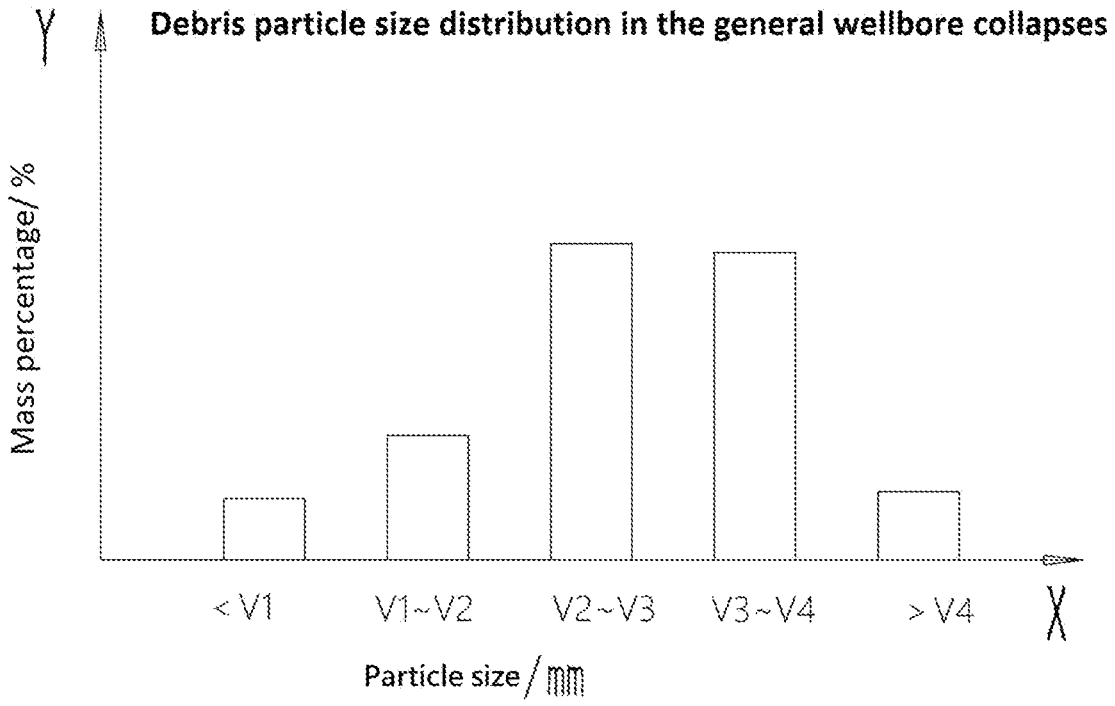
FIG. 15 The standard partical diameter distribution of cuttings in the general wellbore collapses.
Figure 16:
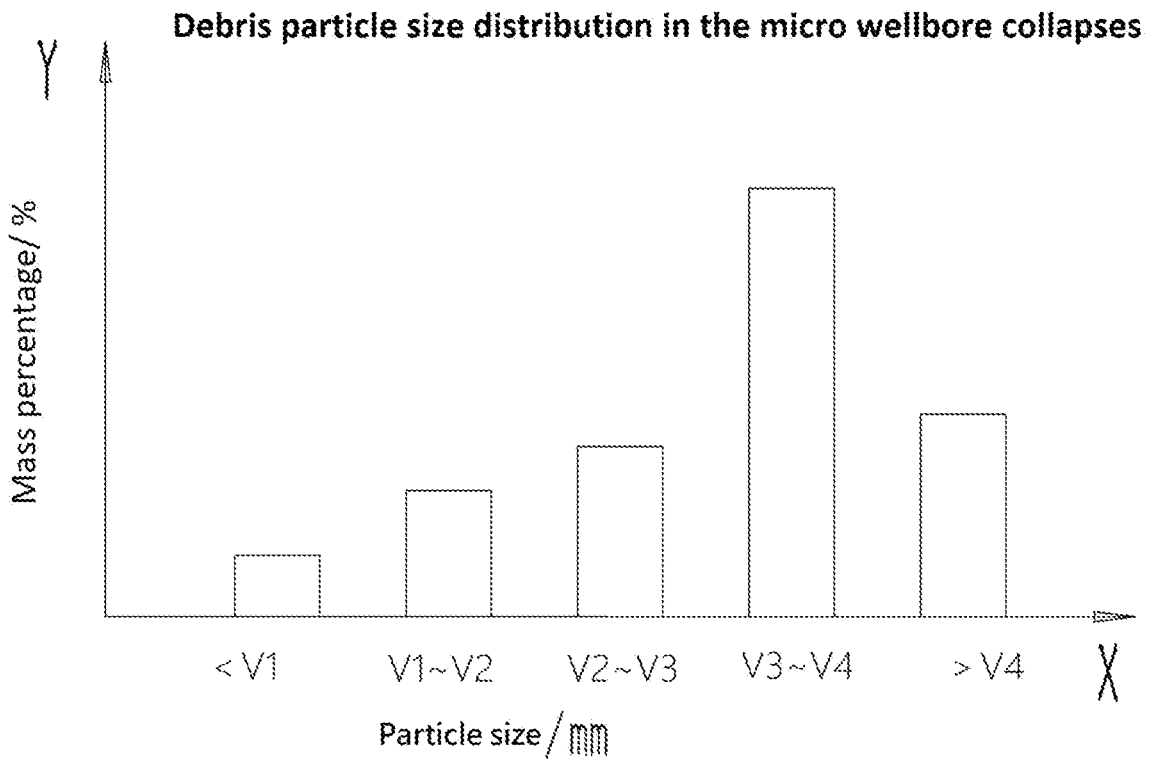
FIG. 16 The standard partical diameter distribution of cuttings in the micro wellbore collapse.
Figure 17:
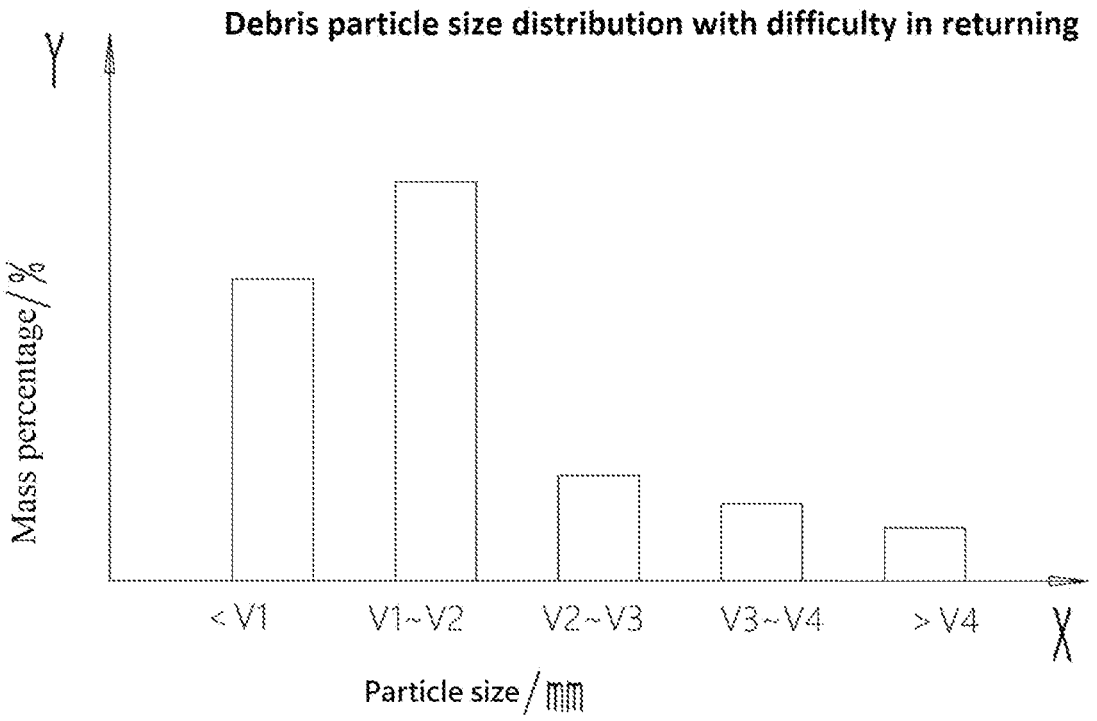
FIG. 17 The standard partical diameter distribution of cuttings with difficulty in returning.

As shown in FIG. 11, a downhole failure analysis and processing method based on partical diameter distribution of cuttings includes the following steps:

S1. Establish a database of standard partical diameter distribution of cuttings for normal drilling and different types of downhole failures, including the following sub-steps:

a1. Take the first drilling construction well in a certain area that can represent the geological characteristics, drilling design and drilling construction technology of the block as a reference well;

b1. Divide equally the total drilling time T of the reference well into sampling periods with time interval ΔT, select the debris discharged in the first Δt period in the sampling period ΔT, and measure the partical diameter distribution of the cuttings, which should be completed in the sampling period ΔT;

c1. The reference well is divided into different well sections according to formation composition and drilling process similarity. As shown in FIG. 12, various other downhole failure monitoring methods are used to identify different types of downhole failures in each well section;

d1. From the normal drilling and the occurrence of different types of downhole failures in each section of the reference well, the representative partical diameter distribution of cuttings is selected as the standard partical diameter distribution of cuttings, and the representative partical diameter distribution of cuttings is identified as: the standard partical diameter distribution of cuttings of normal drilling and the standard partical diameter distribution of cuttings of various downhole failures; for example:

FIG. 13 shows the standard partical diameter distribution of cuttings selected from the normal drilling of a well section;

FIG. 14-16 shows the standard partical diameter distribution of cuttings selected in the process of downhole failure, such as massive collapse of the well wall, general collapse of the well wall, micro-collapse of the well wall and difficulty of flowback;

e1. Establish a standard distribution database of partical diameter of cuttings consisting of well section information, normal drilling or downhole failure information and standard partical diameter distribution of cuttings record. If the standard partical diameter distribution of cuttings of some downhole failure is missing, the record will be left blank and be added when such a failure is encountered in the later drilling process;

S2. Establish a database of different types of downhole failures, including the following sub-steps:

a1. A variety of other downhole failure monitoring methods are adopted. When a well section of the reference well encounters a downhole failure, the causes of the downhole failure are analyzed and a variety of solutions are put forward;

b1. According to the expected effectiveness of the solutions, select different solutions to deal with the downhole failure, until the downhole failure is resolved;

c1. The solution that completely removes the downhole failure will be recorded into the downhole failure treatment scheme database as a standard downhole failure treatment scheme. If the downhole failure can't be solved or the solution effect is not satisfactory, a relatively good downhole failure treatment scheme will be selected as the reference downhole failure treatment scheme and recorded into the downhole failure treatment scheme database. The reference downhole failure treatment scheme will be replaced by the downhole failure treatment scheme that successfully removes the downhole failure in the later drilling process.

S3. Record the real-time partical diameter distribution of cuttings during the drilling in the non-reference wells. The specific operation methods are as follows:

On the basis of establishing the database of standard partical diameter distribution of cuttings and the database of downhole failure treatment scheme in a certain block, as for the non-reference wells in the same block, take the time interval ΔT as the sampling period, and the first Δt in the time interval ΔT as the sampling interval. Test the real-time partical diameter distribution of cuttings in the Δt interval according to the same test method as the standard partical diameter distribution of cuttings based on the debris returns in the Δt interval;

S4. Determine whether the real-time partical diameter distribution of cuttings is consistent with the standard partical diameter distribution of cuttings by:

After obtaining the real-time partical diameter distribution of cuttings in a sampling period, the similarity between the real-time partical diameter distribution of cuttings and all the standard partical diameter distribution of cuttings in the same well section in the standard distribution database of partical diameter of cuttings is analyzed, and whether the real-time partical diameter distribution of cuttings is consistent with the standard partical diameter distribution of cuttings is determined according to the similarity;

S5. Make a real-time judgement according to whether the real-time partical diameter distribution of cuttings is consistent with the standard partical diameter distribution of cuttings: to continue drilling or to carry out failure treatment, and update the data of the standard distribution database of partical diameter of cuttings and the failure treatment scheme database, including the following:

When the real-time partical diameter distribution of cuttings is consistent with the standard partical diameter distribution of cuttings of normal drilling, drilling continues according to the current operating parameters;

When the real-time partical diameter distribution of cuttings is consistent with the standard partical diameter distribution of cuttings of some downhole failure in this section, the standard downhole failure treatment scheme corresponding to the failure should be found from the database of the failure treatment scheme immediately. After the downhole failure is resolved, continue to drill. If there is a reference failure treatment scheme in the failure treatment scheme database, the downhole failure can be treated according to the reference failure treatment scheme, or a new failure treatment scheme can be formulated according to the failure cause. When the new failure treatment scheme can completely resolve the downhole failure, the new scheme will be recorded in the failure treatment scheme database as the standard downhole failure treatment scheme. When the new failure treatment scheme cannot completely resolve the downhole failure, but the effect is better than that of the reference downhole failure treatment scheme, the original reference downhole failure treatment scheme will be replaced by the new scheme and the new scheme will be recorded in the failure treatment scheme database;

When the real-time partical diameter distribution of cuttings is not consistent with the standard partical diameter distribution of cuttings in the standard distribution database of partical diameter of cuttings of the same well section, it shows that there is a new failure that has never appeared before, so the drilling should be stopped immediately, the downhole failure should be analyzed, and an effective failure treatment scheme should be developed. The drilling will continue after the failure is resolved. In this process, when the downhole failure is analyzed, it is necessary to add the standard partical diameter distribution of cuttings corresponding to the failure to the standard distribution database of partical diameter of partical diameter of cuttings; when the failure treatment scheme is effective, it is necessary to add the failure treatment scheme to the downhole failure treatment scheme database as the standard failure treatment scheme or the reference failure treatment scheme.

The method for testing the partical diameter distribution of the cuttings comprises the following steps:

a1. Take the time Δt as the sampling interval, and use a multilevel diameters of cuttings screening and weighing device to screen and weigh the debris returned in the Δt interval according to the distribution of cuttings;

b1. The total weight of the sampled debris is recorded as W, and the weights of the cuttings of all partical diameters are recorded as $W_1, W_2 \ldots, W_k \ldots, W_n$;

c1. In interval Δt, the partical diameter distribution of cuttings is $F_{tk}=(f_1, f_2 \ldots, f_k \ldots, f_n)$, of which $$f_k = \frac{W_k}{W};$$

d1. The partical diameter distribution of cuttings in all intervals Δt during the normal drilling period of a certain well section is analyzed, and a representative one is selected as $F_z$, i.e. the standard partical diameter distribution of cuttings of normal drilling in this well section:

e1. The partical diameter distribution of cuttings of a certain well section in all intervals Δt in a certain downhole failure period is analyzed, and a representative one is selected as $F_g$, i.e. the standard partical diameter distribution of cuttings of such downhole failure in this section:

According to the similarity, the invention determines whether the real-time partical diameter distribution of cuttings is consistent with the standard partical diameter distribution of cuttings. The details are as follows:

a1. The mass percentage of the debris of different diameters in the standard partical diameter distribution of cuttings is written as $p=(p_1, p_2 \ldots, p_k \ldots, p_n)$;

The mass percentage of the debris of different diameters in the real-time partical diameter distribution of cuttings is written as $q=(q_1, q_2, \ldots, q_k \ldots, q_n)$;

b1. The deviation of real-time partical diameter distribution of cuttings relative to the standard partical diameter distribution of cuttings is written as $g=(g_1, g_2, \ldots, g_k \ldots, g_n)$;

Among them, $g_k$ is single-level deviation, $$g_k = \frac{|p_k - q_k|}{p_k};$$

$G_p$ is total deviation, $G_p=g_1+g_2+\ldots,+g_k \ldots,+g_n$ c1. Take $d_k$ as the single-level similarity, $d_k=1-g_k$; take $D_s$ as the total similarity, $D_s=n-G_p$; n is the size level of debris;

d1. Set the single-level consistent judgement value $d_d$ and the overall consistent judgement value $D_d$ based on the actual drilling experience;

e1. When $d_k \geq d_d$, k=1, 2 . . . , k . . . , n, and $D_s \geq D_d$, it is determined that the real-time partical diameter distribution of cuttings is consistent with the standard partical diameter distribution of cuttings. Otherwise, the real-time partical diameter distribution of cuttings is not consistent with the standard partical diameter distribution of cuttings.

The foregoing is not in any form a limitation to the invention. Although the invention has been disclosed through the above embodiment, such embodiment is not used to limit the invention. Any technical personnel familiar with this field, within the scope of the technical scheme of this invention, may change or modify the technical content of the disclosure as the equivalent embodiment, but any simple modification, equivalent change and modification of the above embodiment according to the technical essence of this invention shall still fall within the scope of the technical scheme of this invention.

The invention claimed is:

1. A downhole failure analysis and processing method based on particle diameter distribution of cuttings, comprising the following steps:

S1. establishing a database of a standard distribution of particle diameter of cuttings for normal drilling and different types of downhole failures;

S2. establishing a failure treatment scheme database of treatment schemes for different types of downhole failures;

S3. collecting a debris returning from a wellhead and using a sieving and weighing device to sieve and weigh the debris according to the particle diameter to obtain a real-time particle diameter distribution of cuttings, and then determining whether the real-time particle diameter distribution of cuttings is consistent with the standard particle diameter distribution of cuttings;

S4. making a real-time judgement based on whether the real-time particle diameter distribution of cuttings is consistent with the standard particle diameter distribution of cuttings:

if the real-time particle diameter distribution of cuttings is consistent with the standard particle diameter of cuttings distribution of normal drilling, continue drilling;

if the real-time particle diameter distribution of cuttings is consistent with the standard particle diameter of cuttings distribution of different types of downhole failures, a corresponding standard downhole failure treatment scheme shall be searched from the failure treatment scheme database; after a downhole failure is handled and resolved, continue to drill;

if the real-time particle diameter distribution of cuttings is not consistent with any standard particle diameter distribution of cuttings in the database of the standard distribution of particle diameter of cuttings, it means that there is a new failure in the downhole that has never occurred before, stopping drilling, carrying out downhole failure analysis, and formulating effective failure treatment schemes; continuing drilling after a failure treatment is completed, and updating a data of the standard distribution database of particle diameter of cuttings and the failure treatment scheme database;

wherein the step for obtaining the particle diameter distribution of cuttings is as follows:

a. taking a time Δt as a sampling interval and sieving and weighing the debris returned in the sampling interval Δt according to the particle diameter of cuttings with the sieving and weighing device;

b. recording a total weight of sampled debris W and a weight of the particle diameter of cuttings $W_k$; and c. calculating the particle diameter distribution of cuttings $f_k$ in the sampling interval Δt according to the following formula:

$$f_k = \frac{W_k}{W};$$

wherein $f_k$ means the particle diameter of cuttings distribution; W means a total weight of sampled debris; and $W_k$ means a weight of different diameters of cuttings.

2. The downhole failure analysis and processing method based on particle diameter distribution of cuttings according to claim 1, wherein the step for judging whether the real-time particle diameter distribution of cuttings is consistent with the standard particle diameter distribution of cuttings is as follows:

A. calculating a single-level deviation $g_k$ of the real-time particle diameter distribution of cuttings relative to the standard particle diameter distribution of cuttings according to the following formula:

$$g_k = \frac{|p_k - q_k|}{p_k};$$

wherein $p_k$ means a mass percentage of the debris in the standard particle diameter distribution of cuttings; and $q_k$ means a mass percentage of the debris in the real-time particle diameter distribution of cuttings;

B. summing all single-level deviations $g_k$ to obtain the real-time particle diameter distribution of cuttings relative to the standard particle diameter distribution of cuttings;

C. obtaining a single-level similarity $d_k$ and $D_s$ according to the single-level deviation $g_k$ and the single deviation $G_p$:$d_k=1-g_k$;

$$D_s=n-Gp;$$

wherein n means a particle diameter level of cuttings;

D. making a judgment according to a set single-level consistent judgement value $d_d$ and the overall consistent judgement value of similarity $D_d$, wherein when $d_k \geq D_d$, k=1, 2, . . . k, and Ds $\geq D_d$, the real-time particle diameter distribution of cuttings is consistent with the standard particle diameter distribution of cuttings; Otherwise, the real-time particle diameter distribution of cuttings is not consistent with the standard particle diameter distribution of cuttings.

3. A downhole failure analysis and processing method based on particle diameter distribution of cuttings, comprising the following steps:

S1. establishing a database of a standard distribution of particle diameter of cuttings for normal drilling and different types of downhole failures;

S2. establishing a failure treatment scheme database of treatment schemes for different types of downhole failures;

S3. collecting a debris returning from a wellhead and using a sieving and weighing device to sieve and weigh the debris according to the particle diameter to obtain a real-time particle diameter distribution of cuttings, and then determining whether the real-time particle diameter distribution of cuttings is consistent with the standard particle diameter distribution of cuttings;

S4. making a real-time judgement based on whether the real-time particle diameter distribution of cuttings is consistent with the standard particle diameter distribution of cuttings:

if the real-time particle diameter distribution of cuttings is consistent with the standard particle diameter of cuttings distribution of normal drilling, continue drilling;

if the real-time particle diameter distribution of cuttings is consistent with the standard particle diameter of cuttings distribution of different types of downhole failures, a corresponding standard downhole failure treatment scheme shall be searched from the failure treatment scheme database; after a downhole failure is handled and resolved, continue to drill;

if the real-time particle diameter distribution of cuttings is not consistent with any standard particle diameter distribution of cuttings in the database of the standard distribution of particle diameter of cuttings, it means that there is a new failure in the downhole that has never occurred before, stopping drilling, carrying out downhole failure analysis, and formulating effective failure treatment schemes; continuing drilling after a failure treatment is completed, and updating a data of the standard distribution database of particle diameter of cuttings and the failure treatment scheme database;

wherein the step for judging whether the real-time particle diameter distribution of cuttings is consistent with the standard particle diameter distribution of cuttings is as follows:

A. calculating a single-level deviation $g_k$ of the real-time particle diameter distribution of cuttings relative to the standard particle diameter distribution of cuttings according to the following formula:

$$g_k = \frac{|p_k - q_k|}{p_k};$$

wherein $p_k$ means a mass percentage of the debris in the standard particle diameter distribution of cuttings; and $q_k$ means a mass percentage of the debris in the real-time particle diameter distribution of cuttings;

B. summing all single-level deviations $g_k$ to obtain the real-time particle diameter distribution of cuttings relative to the standard particle diameter distribution of cuttings;

C. obtaining a single-level similarity $d_k$ and $D_s$ according to the single-level deviation $g_k$ and the single deviation $G_p$:$d_k=1-g_k$;

$$D_s=n-Gp;$$

wherein n means the particle diameter level of cuttings;

D. making a judgment according to a set single-level consistent judgement value $d_d$ and the overall consistent judgement value of similarity $D_d$, wherein when $d_k \geq D_d$, k=1, 2, . . . k, and $D_s \geq D_d$, the real-time particle diameter distribution of cuttings is consistent with the standard particle diameter distribution of cuttings; Otherwise, the real-time particle diameter distribution of cuttings is not consistent with the standard particle diameter distribution of cuttings.

* * * * *